US005664961A

United States Patent [19]

Tsuji et al.

[11] Patent Number: 5,664,961

[45] Date of Patent: Sep. 9, 1997

[54] CONNECTOR HOUSING WITH LOCK

[75] Inventors: Masanori Tsuji; Motohisa Kashiyama, both of Shizuoka, Japan

[73] Assignee: Yazaki Corporation, Tokyo, Japan

[21] Appl. No.: 760,898

[22] Filed: Dec. 6, 1996

Related U.S. Application Data

[63] Continuation of Ser. No. 377,613, Jan. 25, 1995, abandoned.

[30] Foreign Application Priority Data

Jan. 27, 1994 [JP] Japan ..... 6-023550

[51] Int. Cl.[6] ..... H01R 13/625

[52] U.S. Cl. ..... 439/358; 439/353

[58] Field of Search ..... 439/350, 351, 439/352, 354, 355, 357, 358

[56] References Cited

U.S. PATENT DOCUMENTS

| | | | |
|---|---|---|---|
| 3,544,951 | 12/1970 | Roberts | 439/352 |
| 5,219,300 | 6/1993 | Yagi et al. | 439/532 |
| 5,234,356 | 8/1993 | Maejima et al. | 439/357 |
| 5,254,014 | 10/1993 | Yagi et al. | 439/357 |
| 5,380,217 | 1/1995 | Yagi et al. | 439/358 |
| 5,399,045 | 3/1995 | Yoneda et al. | 439/357 |

FOREIGN PATENT DOCUMENTS

| | | |
|---|---|---|
| 60-64588 | 5/1985 | Japan . |
| 62-18979 | 2/1987 | Japan . |

*Primary Examiner*—Hien Vu

*Attorney, Agent, or Firm*—Sughrue, Mion, Zinn, Macpeak & Seas

[57] ABSTRACT

A locking connector housing capable of insuring an inserting load necessary for locking, improving unlocking performance, and insuring reliability in the strength of a lock arm, is provided. Both lateral sides of a front end of a lock arm are supported by front support portions. The lock arm has a retaining projection, engageable with a retaining portion of a mating housing, and an unlocking portion. The front end support portions are disposed on a pair of protective walls erected on an upper wall surface of a housing. A rear end portion of the lock arm is folded back to form a band portion, with a tail end of the band portion being supported by a rear support portion on the upper wall surface of the housing. Reinforcing ribs are arranged on both lateral ends of the lock arm, each reinforcing rib being such that the height thereof is tapered from the front to the rear. The lock arm having the reinforcing ribs 14 and the band portion allows the housings to be engaged and locked, and requires only a small unlocking force.

6 Claims, 6 Drawing Sheets

CONNECTOR HOUSING WITH LOCK

This is a Continuation of application Ser. No. 08/377,613, filed Jan. 25, 1995, now abandoned.

BACKGROUND OF THE INVENTION

1. Field of the Invention

The invention relates to connector housings adapted for use in electrically connecting wire harnesses for automobiles. More particularly, the invention is directed to a connector housing with a lock (hereinafter referred to simply as a "housing") which prevents a lock arm disposed on an outer surface of the connector housing from being broken due to excessive flexion at the time of a locking or unlocking operation.

2. Related Art

A conventional flexible lock arm arranged on an outer wall of a housing for engaging and locking connectors with each other is supported at both ends thereof. Such a flexible lock arm is disclosed in, e.g., Japanese Unexamined Utility Model Publication No. 62-18979 and the like. As shown in FIG. 5, the front portion of a male housing 31 having terminal accommodating chambers 42 formed therein is designed to be inserted into a hood member 33 arranged at the front portion of a female housing 32 having terminal accommodating chambers 43 formed therein. Each terminal accommodating chamber 42 accommodates a connecting terminal, and each terminal accommodating chamber 43 accommodates a connecting terminal of such a different type as to correspond to the aforementioned connecting terminal. On one wall surface of the hood member 33 is a retaining chamber 35 having a retaining portion 34.

Further, on one outer wall surface 37 of the male housing 31 is a lock arm 39 whose front and rear ends are supported by support portions 37, 38. The lock arm 39 has a retaining projection 40 that is to be retained by the retaining portion 34 and an unlocking portion 41 for releasing the engagement of both connectors.

Since a thickness 39*a* of the lock arm 39 is such that both the front and rear ends thereof are greater and the vicinity of the middle portion thereof is smaller, the vicinity of the middle portion thereof is particularly flexible even if the lock arm 39 is made of a hard synthetic resin.

In the aforementioned construction, when the male housing 31 is inserted into the hood member 33 of the female housing 32, first, the inclined surface at the front end of the retaining projection 40 is first abutted against the front end of the retaining portion 34 to be pressed downward. Then, the retaining projection 40 is retained by the retaining portion 34, thereby causing the male housing 31 to be engaged with and locked by the female housing 32.

Further, to release the engagement of both connectors, an unlocking portion 41 is pressed, so that the lock arm 39 is so flexed to as to release the retaining projection 40 from the retaining portion 34. When the male housing 31 is pulled out under this condition, the male housing 31 is separated from the female housing 32.

As shown in FIG. 6, the lock arm 39 is pressed and flexed during the engaging and locking operation or during the unlocking operation. Since the thickness 39*a* is made smaller in the vicinity of the rear end of the retaining projection 40, the movement of the retaining projection 40 is almost equal to a parallel movement. Therefore, a displacement necessary for unlocking the lock arm 39 is determined by the height $h_1$ of the retaining projection 40, requiring a smaller flexing space $h_2$ compared with a displacement necessary for unlocking a cantilevered lock arm. As a result, not only the housing can be downsized, but also an engagement gap $\delta$, which is a cause of backlash after the engagement and locking, can be made small, which in turn prevents wear and noise of the lock mechanism.

However, the aforementioned conventional lock arm 39 requires a large inserting force so that the retaining projection 40 can pass under the retaining portion 34 of the female housing 32 at the time of engaging and locking the lock arm 39. As a result, a large inserting load is applied to the support portion 37 at the front end of the lock arm 39, imposing a problem that the lock arm 39 is plastically deformed or broken by the excessive inserting force as shown in FIG. 7(*a*).

Further, at the time of unlocking the lock arm 39, a large unlocking load is applied to the support portion 38 at the rear end as the lock arm 39 is pressed by the unlocking portion 41, imposing a problem that the lock arm 39 is plastically deformed or broken by the excessive releasing force as shown in FIG. 7(*b*).

Moreover, while it is desirable that the inserting load is appropriately large and that the releasing load is small, there is little difference between the inserting load and the releasing load in the lock arm 39 support structure shown in FIG. 6, and since greater consideration is given to the locking operation at the time of insertion, imposing a problem that unlocking operability is not satisfactory.

Still further, since the thickness 39*a* along the length of the lock arm 39 is tapered, imposing a problem that reliability in the strength of the thin portion of the retaining projection is impaired.

An object of the invention is to provide a connector housing with a lock capable of ensuring an inserting load necessary for locking, improving unlocking performance, and ensuring reliability in the strength of the lock arm.

SUMMARY OF THE INVENTION

To achieve the above and other objects, the invention provides a locking connector housing, comprising: a lock arm, disposed on a single outer wall surface of the connector housing, said lock arm having a front portion and a rear portion; a retaining projection, disposed on an upper portion of said lock arm, for engaging a retaining portion of a mating connector housing; an unlocking portion, disposed on said upper portion of said lock arm rearward of said retaining projection, for releasing engagement of said connector housing with the mating connector housing; a pair of protective walls, disposed vertically on said outer wall surface of said connector housing for protecting lateral portions of said lock arm, front inner wall surfaces of said protective walls respectively supporting both lateral sides of said front portion of said lock arm; and a resilient band portion having a support portion, integrally formed with said rear portion of said lock arm, supported on said outer wall surface by said support portion, said band portion being substantially U-shaped. The band portion is formed by folding a rear end portion of the lock arm back.

The lock arm may also be provided with reinforcing ribs, disposed projecting from edges of a lower portion of said lock arm for reinforcing said lock arm, said reinforcing ribs tapering from said front portion of said lock arm to said rear portion of said lock arm.

In the inventive locking connector housing, a pair of protective walls for protecting both lateral portions of the lock arm are erected on the outer wall surface. Both lateral sides of a front end portion of the lock arm are supported by front inner wall surfaces of the protective walls. A band portion is formed by folding a rear end portion of the lock arm back, and an end portion of the band portion is supported by a support portion on the outer wall surface. In addition, reinforcing ribs are disposed, the height of each reinforcing rib being tapered from a front portion on both lateral ends of the lock arm to a rear portion. As a result of this construction, a stress acting on the front end portion of the lock arm at the time of inserting and engaging the lock arm is distributed around the protective walls on both lateral sides. This structure not only prevents the lock arm from being broken at the time of inserting the lock arm, but also allows the retaining projection of the lock arm to be locked by the retaining portion of the mating housing.

Further, when the unlocking portion is pressed at the time of disengaging the lock arm, the lock arm is flexed downward by resiliency of the band portion, which causes the retaining projection to be released from the retaining portion, thereby unlocking the lock arm. A smaller pressing force is required during this disengaging operation than the inserting force required during the engaging operation. Thus, not only is unlocking operability improved, but also stress acting on the rear end portion of the lock arm is reduced, thereby preventing the lock arm from being broken at the time of release.

Furthermore, the tapered reinforcing ribs arranged on both lateral ends of the lock arm not only allow the lock arm to be stronger, but also contribute to making the thickness of the lock arm uniform because the position at which the lock arm is bent is determined thereby. As a result, not only the cost of manufacture can be reduced, but also the reliability of the lock arm can be increased.

BRIEF DESCRIPTION OF THE DRAWINGS

FIG. 3(*b*) shows the lock arm in the course of being inserted into a mating housing and engaged therewith; and FIG. 3(*c*) shows how the lock arm is disengaged.

FIG. 7(*b*) shows how the lock arm is disengaged.

DETAILED DESCRIPTION OF THE PREFERRED EMBODIMENT

A connector housing with a lock, which is an embodiment of the invention, will now be described with reference to FIGS. 1 to 4.

Figure 4:
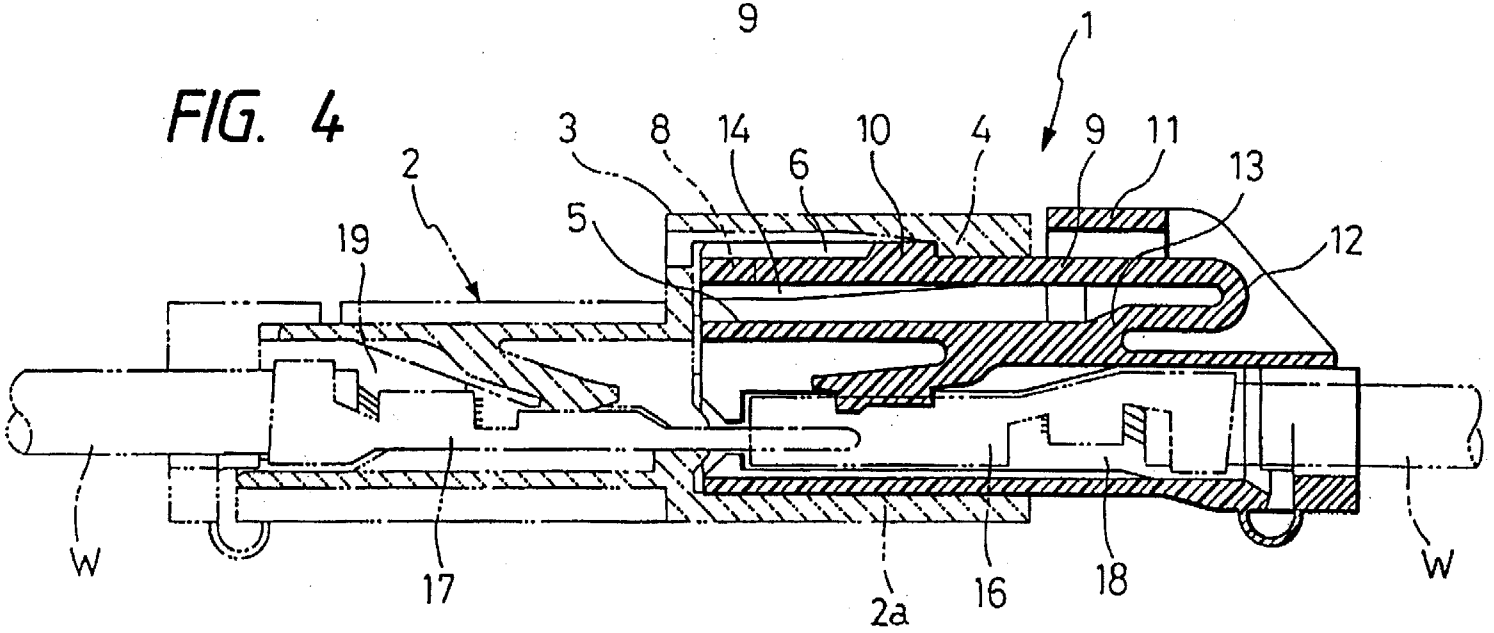
FIG. 4 is a sectional view showing the connector housing with a lock having been engaged with the mating housing in FIG. 1.

As shown in FIG. 4, the front portion of a male housing 1 is inserted into a hood member 2*a* of a mating female housing 2 indicated by a two dot chain line. When a retaining projection 10 is engaged while passing under a retaining portion 4, the engagement of both connector housings is completed. Accordingly, a female terminal 16 with an electrical cable W connected thereto in a terminal accommodating chamber 18 arranged inside the male housing 1 is electrically connected to a male terminal 17 with an electrical cable W connected thereto inserted into a terminal accommodating chamber 19 arranged inside the female housing 2.

A box-like retaining chamber 3 is projected from an outer wall surface on the front portion of the female housing 2. This retaining chamber 3 has the retaining portion 4 for engaging and locking the male housing 1 at the front end thereof.

Figure 1:
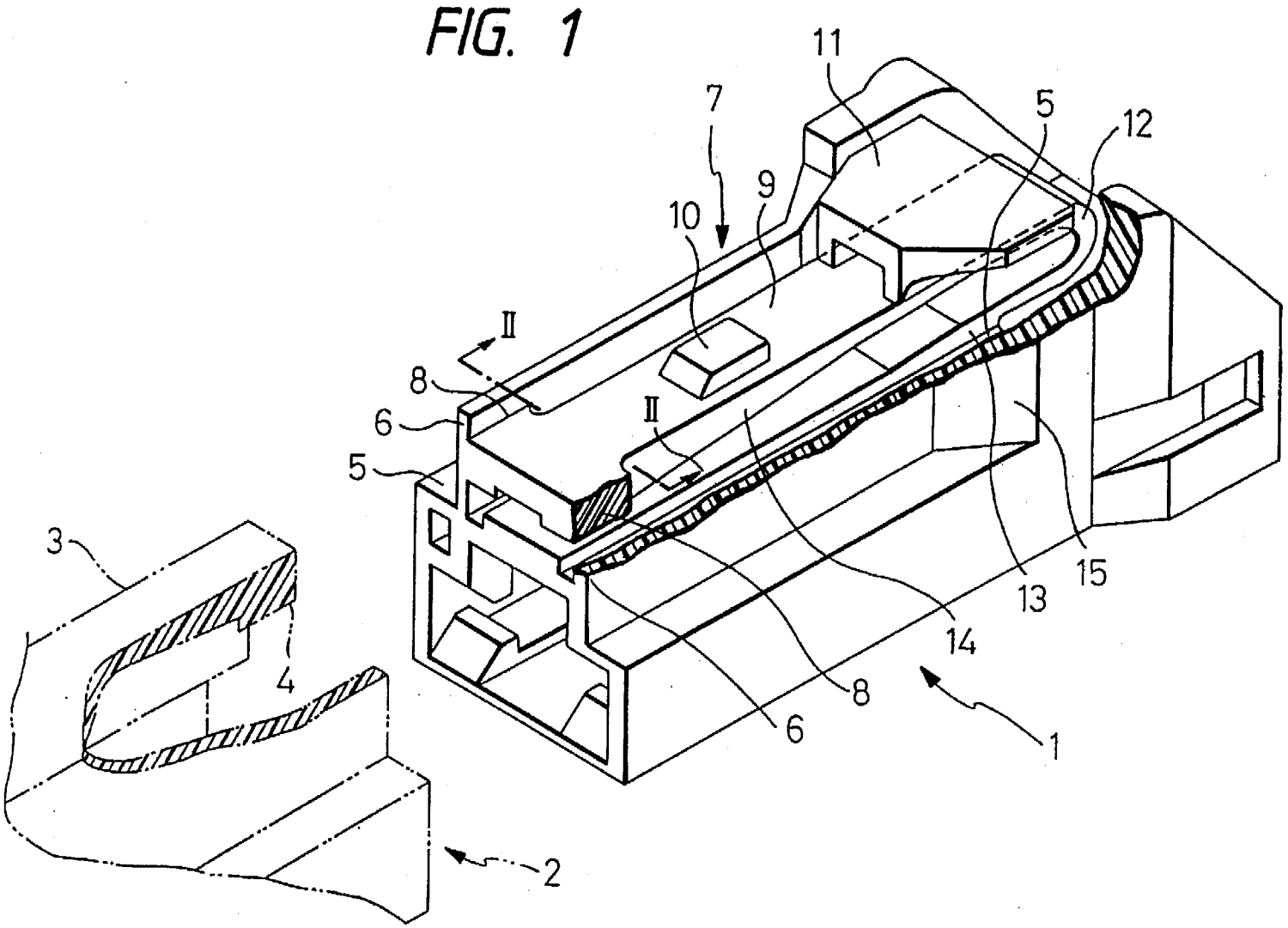
FIG. 1 is a perspective view showing a connector housing with a lock, which is an embodiment of the invention.

As shown in FIG. 1, the male housing 1 has a retaining portion 7 interposed between a pair of protective walls 6 erected on an outer wall surface 5 thereof so as to project from the outer wall surface 5. Within the retaining portion 7 is a rearwardly extending band plate-like lock arm 9. The lock arm 9 has front support portions 8 whose both lateral sides, the lateral sides of the front end portion of the lock arm 9, are integrally supported by the protective walls 6.

A retaining projection 10 and an unlocking portion 11 are integrally formed on the lock arm 9. The retaining projection 10 is retained by the retaining portion 4 of the female housing 2. The unlocking portion 11 serves to release the retaining projection 10 from the retaining portion 4. The rear end portion of the lock arm 9 is folded back to form a U-shaped band portion 12, and the tail end of the band portion 12 is integrally supported by a rear support portion 13 on the outer wall surface 5. Thus, the lock arm 9 integrally formed on the male housing 1 is supported at three positions: the front portion of the lock arm 9 is supported by the two front support portions 8, and the rear portion thereof is supported by the rear support portion 13.

Figure 2:
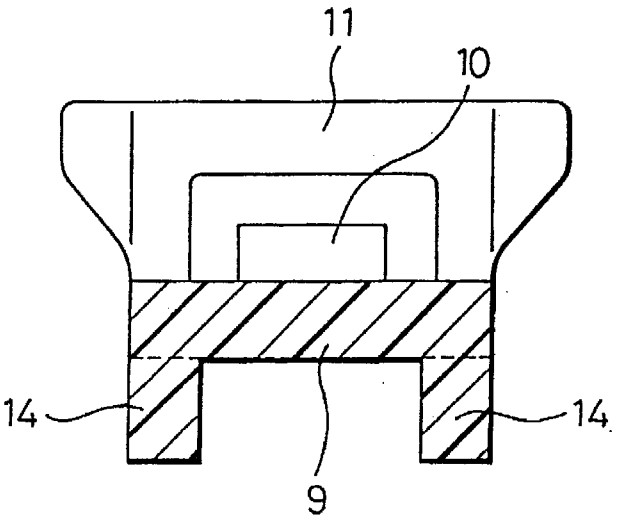
FIG. 2 is a sectional view of a lock arm taken along a line II—II of FIG. 1.

Further, reinforcing ribs 14 are integrally formed on both lateral ends of the lock arm 9. Each reinforcing rib 14 extends from the front toward the vicinity of an intermediate portion in the rear so that the height thereof tapers from front to back. As shown in FIG. 2, the reinforcing ribs 14 extend downward from the bottom lateral ends of the lock arm 9, not only reinforcing both lateral ends of the lock arm 9, but also providing a point of inflection for substantially bending the rear end portions of the reinforcing ribs 14.

To facilitate the operator in depressing unlocking portion 11, the width of unlocking portion 11 is increased. Also, the distance between the protective walls 6 on both lateral sides in the rear is increased through inclined surface portions 15.

Figure 3A:
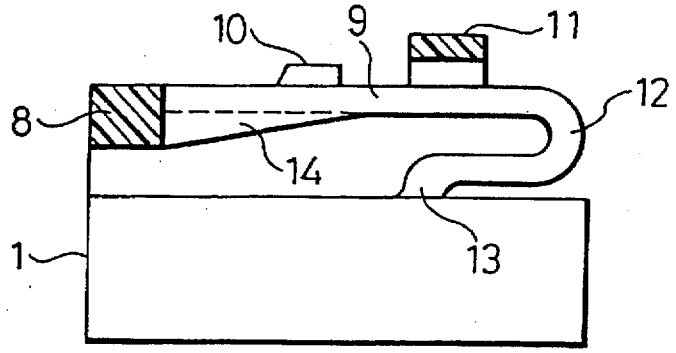
FIG. 3 is a diagram illustrative of a mode of operation of the lock arm at the time of engaging and disengaging the lock arm in FIG. 1, in which FIG. 3(*a*) shows a no-load condition before engagement.
Figure 3B:
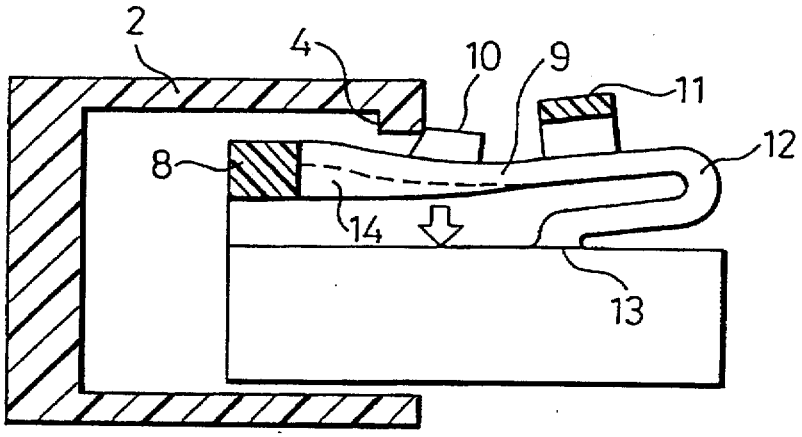
Figure 3C:
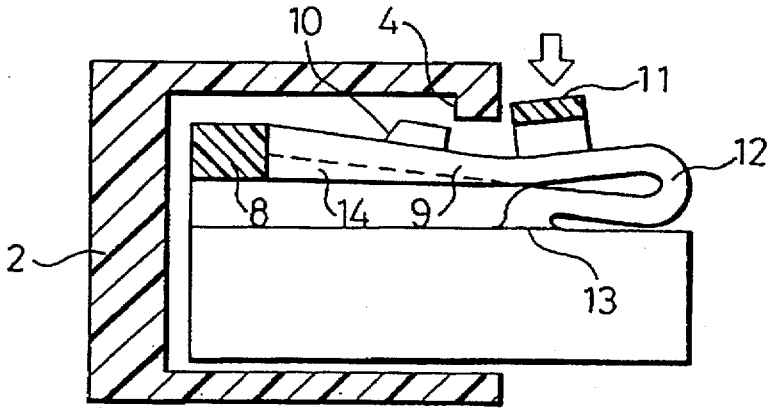
Figure 5:
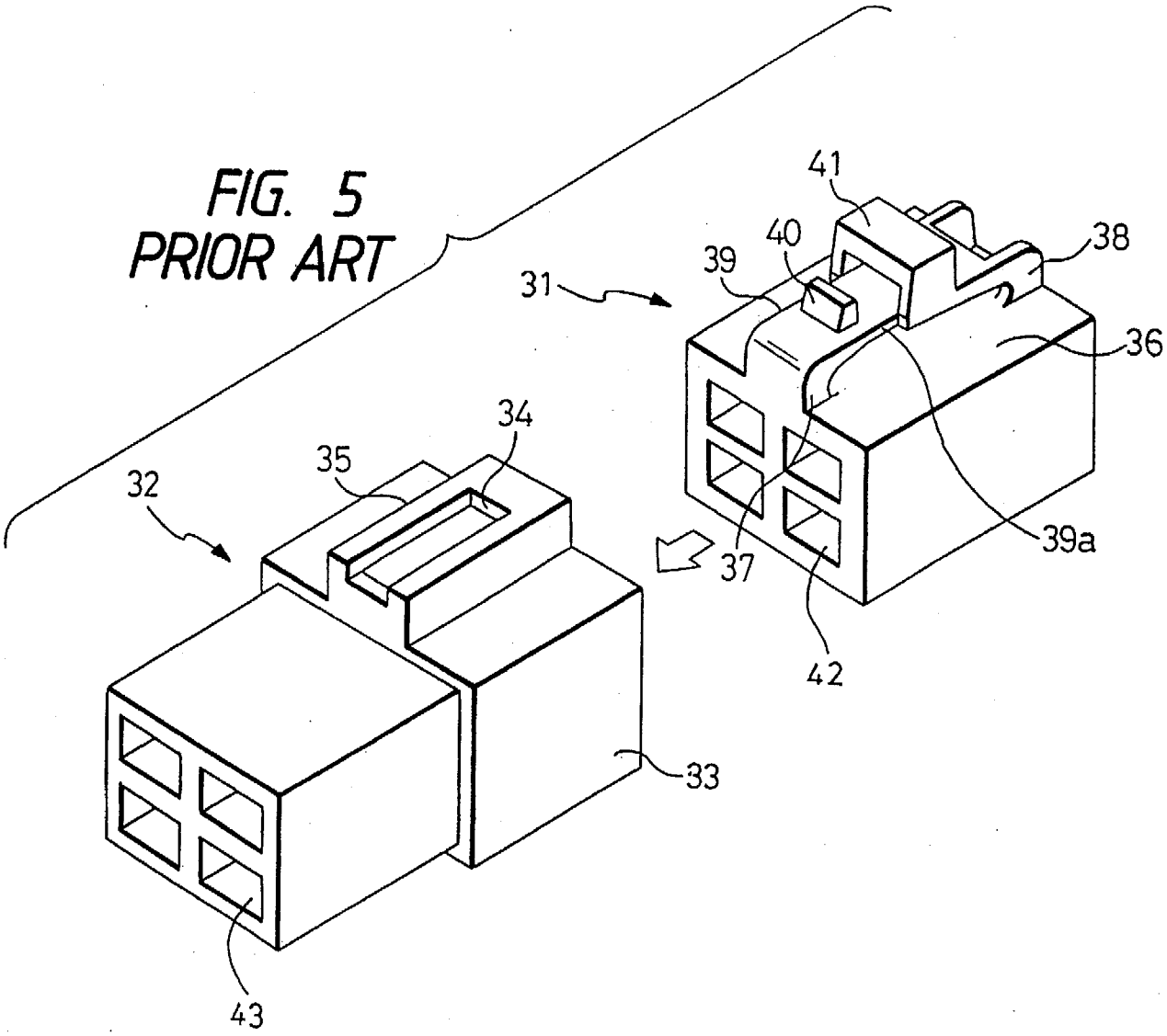
FIG. 5 PRIOR ART
FIG. 5 is a perspective view showing a conventional connector housing with a lock.
Figure 6:
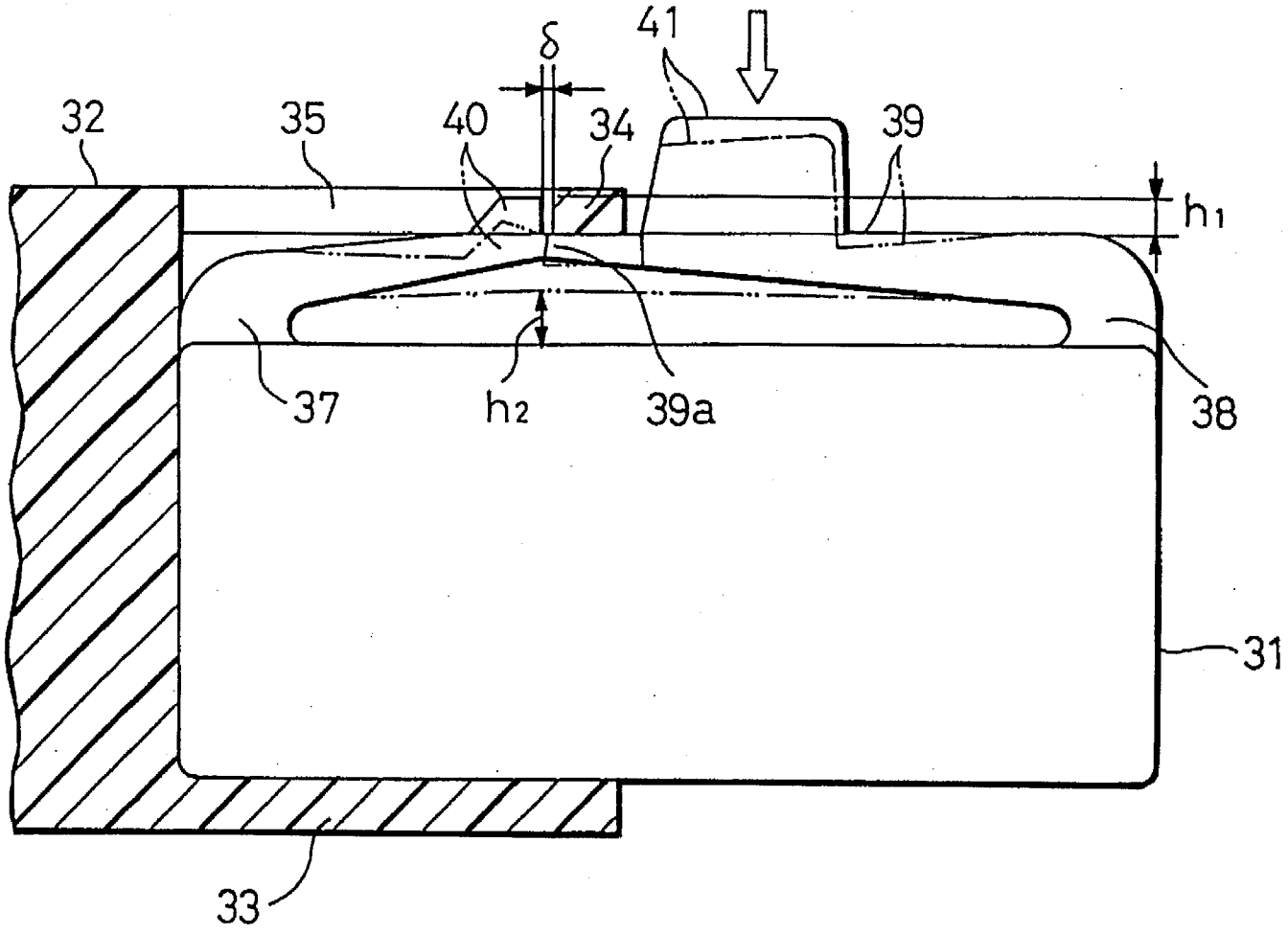
FIG. 6 PRIOR ART
FIG. 6 is a diagram illustrative of a mode of operation of a lock arm in FIG. 5.
Figure 7A:
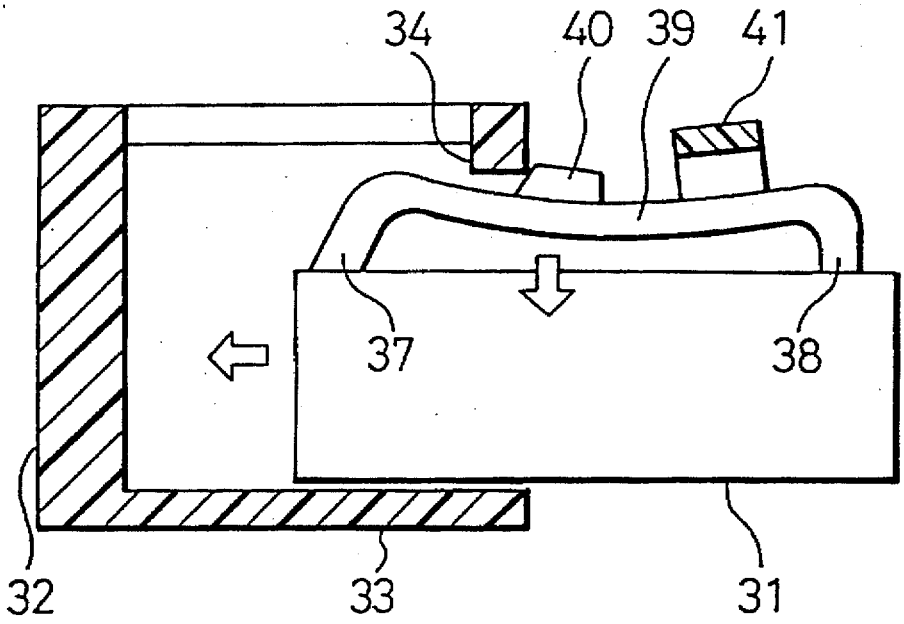
FIG. 7(a) PRIOR ART
FIG. 7 is a diagram illustrative of the lock arm at the time of engaging and disengaging the lock arm in FIG. 5, in which FIG. 7(*a*) shows the lock arm in the course of being engaged.
Figure 7B:
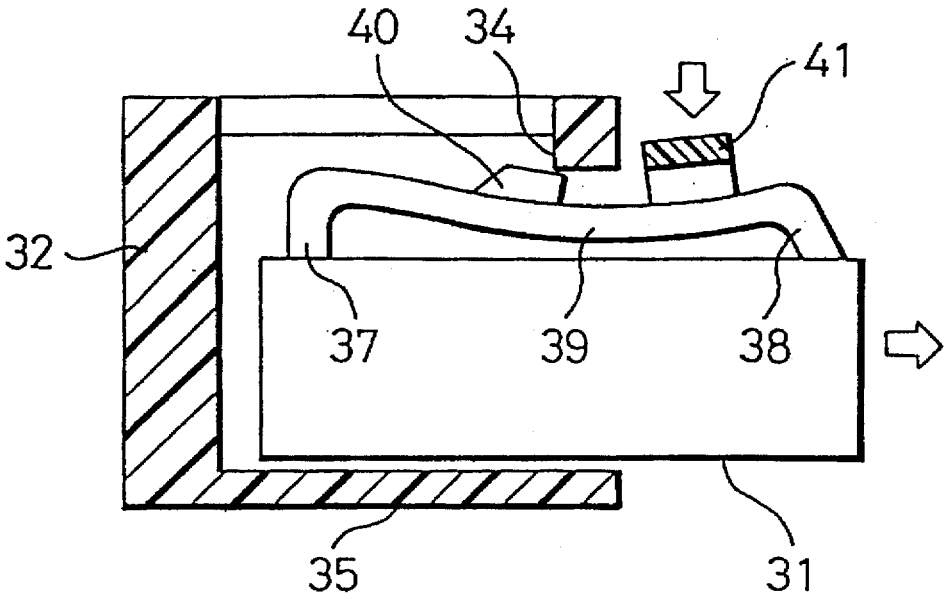
FIG. 7(b) PRIOR ART

Based on the aforementioned construction, the lock arm 9 of the male housing 1 before engagement is not bent, but is in a linear no-load condition as shown in FIG. 3(*a*). Then, when the front portion of the male housing 1 is inserted into the front portion of the female housing 2 as shown in FIG. 3(*b*), the inclined surface at the front end of the retaining projection 10 abuts against the front end of the retaining portion 4. When a large inserting load is applied, the retaining projection 10 slides under and is biased by the retaining portion 4, and the lock arm 9 flexes downward. Retaining projection 10 soon passes under the retaining portion 4, and engages with and is locked by the retaining portion 4. Finally, the flexed lock arm 9 returns to its original linear condition.

The inserting load peaks at the time the inclined surface at the front end of the retaining projection 10 passes under the retaining portion 4 (FIG. 3(*b*)). The retaining force of this inserting load causes the retaining projection 10 to pass under the retaining portion 4 instantly to allow the male housing 1 to be completely engaged with the female housing 2.

Further, the inserting load can be adjusted to a desired value by setting a change in the height of the reinforcing rib 14 of the lock arm 9 during the design stage. Further still, the height of the reinforcing rib is so tapered as to be higher in the front of the lock arm 9 and shorter in the rear thereof. Therefore, when the retaining projection 10 is biased by the retaining portion 4, the reinforcing rib is displaced in a substantially purely vertical direction. This allows the amount of flexion of the lock arm 9 to be small, which in turn contributes to downsizing the male housing 1.

Moreover, a large inserting load is applied to the front end portion of the lock arm 9 because of the construction that is based on locking. However, Since both lateral ends of the lock arm 9 are supported by the front support portions 8, the inserting load is evenly distributed. Therefore, the front support portions 8 are neither deformed nor broken, thereby improving the reliability of the lock arm 9.

To release the engagement and locking as shown in FIG. 3(*c*), the unlocking portion 11 is pressed with a finger, so that the lock arm 9 is flexed downward particularly while bent around the point of inflection, together with the resiliency of the band portion 12. As a result, the retaining projection 10 is released from the retaining portion 4, thereby allowing the male housing 1 to be separated from the female housing 2 if the male housing 1 is pulled out.

Since the rear end portion of the lock arm 9 is folded back to form the band portion 12 having good resiliency as described above, only a small pressing force, i.e., only a small releasing force, is required to be applied to the unlocking portion 11. As a result, the pressing load applied to the rear support portion 13 of the lock arm 9 can be small as well, and this prevents the rear support portion 13 from being deformed or broken, thereby further improving reliability.

Further, since the retaining projection 10 can be released from the retaining portion 4, the disengagement operation can be performed more efficiently.

Still further, since the thicknesses of the reinforcing ribs 14 and the lock arm 9 are uniform, the molding structure can be simplified, which not only contributes to reducing the cost of manufacture, but also prevents generation of shrinkage voids, thus improving productivity and reliability.

It should be noted that the invention is not limited to the aforementioned embodiment, but may be embodied in other modes while modified appropriately. For example, while the reinforcing ribs 14 are arranged so as to extend downward from both lateral ends of the lock arm 9 in the aforementioned embodiment, a single reinforcing rib 14 may be arranged in a middle portion of the lock arm 9.

As described in the foregoing, the invention is characterized as having both lateral sides in the front end portion of the lock arm supported by a pair of protective walls through the front support portions. Therefore, the inserting load can be distributed through both protective walls. As a result, the lock arm is neither likely to be deformed nor broken, which contributes to improving reliability.

Further, the invention is characterized as folding the rear end portion of the lock arm back to form the band portion and causing the tail end of the band portion to be supported by the rear support portion. Therefore, only a small unlocking portion pressing force is required during the unlocking operation, which in turn contributes to implementing efficient unlocking operation.

Still further, the invention is characterized as arranging the reinforcing ribs on the lock arm so as to be tapered from the front toward the vicinity of a middle portion in the rear. Therefore, the point of inflection at the time the lock arm is flexed can be set. As a result, only a small amount of flexion is required for the lock arm during the unlocking operation, which in turn contributes to downsizing the housing.

Still further, the invention is characterized as allowing the thicknesses of the lock arm and the reinforming ribs to be made uniform. Therefore, a simplified mold can be used, which contributes to reducing the cost of manufacture and improving productivity.

What is claimed is:

1. A locking device for an electrical connector housing, comprising:

a lock arm disposed on a single outer wall surface of the connector housing, said lock arm having a front portion and a rear portion arranged in a longitudinal direction of said lock arm;

a retaining projection, disposed on an upper portion of said lock arm, for engaging a retaining portion of a mating connector housing;

an unlocking portion, disposed on said upper portion of said lock arm rearward of said retaining projection, for releasing engagement of said connector housing with the mating connector housing;

a pair of protective walls, disposed vertically on said outer wall surface of said connector housing, for protecting lateral portions of said lock arm, front inner wall surfaces of said protective walls respectively supporting both lateral sides of said front portion of said lock arm;

a resilient band portion having a support portion, integrally formed with said rear portion of said lock arm, supported on said outer wall surface by said support portion, said band portion being substantially U-shaped, wherein said protective walls extend in said longitudinal direction from said front portion toward said rear portion such that said lock arm is disposed therebetween and protected thereby; and reinforcing ribs, disposed projecting from edges of a lower portion of said lock arm for reinforcing said lock arm, said reinforcing ribs tapering from said front portion of said lock arm to said rear portion of said lock arm such that a height of each of said ribs is greater at said front portion than at said rear portion.

2. A locking device for an electrical connector housing according to claim 1, wherein the degree of said taper is such that said retaining projection moves substantially normal to said longitudinal direction.

3. A locking device for an electrical connector housing according to claim 1, wherein said protective walls extend substantially to said rear portion.

4. A locking device for an electrical connector housing according to claim 1, wherein said protective walls extend so as to be disposed on opposite lateral sides of said retaining projection such that said retaining projection is protected thereby.

5. A locking device for an electrical connector housing, comprising:

a lock arm, disposed on a single outer wall surface of the connector housing, said lock arm having a front portion and a rear portion;

a retaining projection, disposed on an upper portion of said lock arm, for engaging a retaining portion of a mating connector housing;

an unlocking portion, disposed on said upper portion of said lock arm rearward of said retaining projection, for releasing engagement of said connector housing with the mating connector housing;

a pair of protective walls, disposed vertically on said outer wall surface of said connector housing for protecting lateral portions of said lock arm, front inner wall surfaces of said protective walls respectively supporting both lateral sides of said front portion of said lock arm;

a resilient band portion having a support portion, integrally formed with said rear portion of said lock arm, supported on said outer wall surface by said support portion, said band portion being substantially U-shaped; and reinforcing ribs, disposed projecting form edges of a lower portion of said lock arm for reinforcing said lock arm, said reinforcing ribs tapering from said front portion of said lock arm to said rear portion of said lock arm such that a height of said ribs is greater at said front portion than at said rear portion.

6. A locking device for an electrical connector housing according to claim 5, wherein the degree of said taper is such that said retaining projection moves substantially normal to said longitudinal direction.

* * * * *